US009708938B2

(12) United States Patent
Evans

(10) Patent No.: US 9,708,938 B2
(45) Date of Patent: Jul. 18, 2017

(54) SWITCHING ROLLER FINGER FOLLOWER WITH RAPID TRANSITION FROM LOCKED TO UNLOCKED MODE AND METHOD THEREOF

(71) Applicant: Schaeffler Technologies AG & Co. KG, Herzogenaurach (DE)

(72) Inventor: Matthew Evans, Warren, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 22 days.

(21) Appl. No.: 14/621,108

(22) Filed: Feb. 12, 2015

(65) Prior Publication Data

US 2015/0240670 A1 Aug. 27, 2015

Related U.S. Application Data

(60) Provisional application No. 61/945,324, filed on Feb. 27, 2014.

(51) Int. Cl.
*F16H 53/06* (2006.01)
*F01L 1/24* (2006.01)

(52) U.S. Cl.
CPC ..... *F01L 1/2416* (2013.01); *F01L 2001/2444* (2013.01); *Y10T 74/206* (2015.01)

(58) Field of Classification Search
CPC ..... F01L 1/2416; F01L 2001/2444
USPC ..... 74/569
See application file for complete search history.

(56) References Cited

U.S. PATENT DOCUMENTS 2,011,863 A * 8/1935 Lovett ..... F01L 1/2416 123/90.36
2,053,743 A * 9/1936 Russell ..... F01L 1/2416 123/90.36
2,071,051 A * 2/1937 Van Ranst ..... F01L 1/2416 123/90.36
4,192,263 A * 3/1980 Kitagawa ..... F01L 1/16 123/90.36
4,539,951 A * 9/1985 Hara ..... F01L 13/00 123/90.17
5,584,268 A * 12/1996 Natkin ..... F01L 1/2416 123/90.46
6,532,924 B1 * 3/2003 Pierik ..... F01L 1/18 123/90.12
8,689,753 B2 * 4/2014 Villemure ..... F01L 1/053 123/90.39

(Continued)

*Primary Examiner* — Vicky Johnson
(74) *Attorney, Agent, or Firm* — Simpson & Simpson, PLLC

(57) ABSTRACT

A switching roller finger follower, including: a body including a locking barrel arranged to receive pressurized fluid; a first chamber partially enclosed by the body; at least one arm rotatably connected to the body; and a locking mechanism. The locking mechanism includes: a locking pin at least partially disposed in the first chamber; and a shuttle assembly including a shuttle pin and a check valve. The shuttle pin: is at least partially disposed in the locking barrel; includes a through-bore in communication with the first chamber; and is displaceable, in response to the pressurized fluid, to engage and disengage the locking pin with the at least one arm. The check valve is arranged to enable flow of the pressurized fluid through the through-bore to the first chamber.

19 Claims, 5 Drawing Sheets

(56) References Cited

U.S. PATENT DOCUMENTS

| | | | | |
|---|---|---|---|---|
| 2003/0098000 | A1* | 5/2003 | Vorih | F01L 1/18 123/90.12 |
| 2006/0157011 | A1* | 7/2006 | Proschko | F01L 1/185 123/90.16 |
| 2006/0225684 | A1* | 10/2006 | Spath | F01L 1/146 123/90.59 |
| 2013/0312681 | A1* | 11/2013 | Schultheis | F01L 1/185 123/90.16 |
| 2015/0083063 | A1* | 3/2015 | Evans | F01L 13/0005 123/90.16 |
| 2015/0135893 | A1* | 5/2015 | Evans | F16H 25/14 74/569 |

* cited by examiner

SWITCHING ROLLER FINGER FOLLOWER WITH RAPID TRANSITION FROM LOCKED TO UNLOCKED MODE AND METHOD THEREOF

CROSS-REFERENCE TO RELATED APPLICATIONS

This application claims the benefit under 35 U.S.C. §119 (e) of U.S. Provisional Patent Application No. 61/945,324, filed Feb. 27, 2014, which application is incorporated herein by reference in its entirety.

TECHNICAL FIELD

The present disclosure relates to a switching roller finger follower with a locking mechanism for use with a valve train of an internal combustion engine. The locking mechanism includes a check valve and a shuttle pin with a through-bore to enable rapid release of fluid pressure in the follower to switch from locked to unlocked mode.

BACKGROUND

A switching roller finger follower is used to control a valve in a valve train for an internal combustion engine. To initiate a locked mode for the finger follower, pressurized fluid is provided by a lash adjuster to a chamber in the finger follower. The pressurized fluid displaces a shuttle pin in a first direction against force applied by a resilient element to the shuttle pin. The displacement of the shuttle pin displaces a locking pin to engage the locking pin with outer arms rotatably connected to a body for the finger follower. To switch to an unlocked mode, the shuttle pin must displace in a second direction, opposite the first direction, to disengage the locking pin from the outer arms. To initiate the switch to the unlocked mode, pressure from the lash adjuster is reduced. To enable displacement of the shuttle pin by the resilient element, fluid must be drained from the chamber. However, the only path for draining the fluid is through the same opening and channel used to supply the fluid for the locking mode. Thus, the switch to the unlocked mode is delayed by resistance to the draining fluid due to back pressure in the lash adjuster.

SUMMARY

According to aspects illustrated herein, there is provided a switching roller finger follower, including: a body including a locking barrel arranged to receive pressurized fluid; a first chamber partially enclosed by the body; at least one outer arm rotatably connected to the body; and a locking mechanism. The locking mechanism includes: a locking pin at least partially disposed in the first chamber; and a shuttle assembly including a shuttle pin and a check valve. The shuttle pin: is at least partially disposed in the locking barrel; includes a through-bore in communication with the first chamber; and is displaceable, in response to the pressurized fluid, to engage and disengage the locking pin with the at least one outer arm. The check valve is arranged to enable flow of the pressurized fluid through the through-bore to the first chamber.

According to aspects illustrated herein, there is provided a switching roller finger follower, including: a body including a locking barrel arranged to receive pressurized fluid; a first chamber partially enclosed by the body; at least one outer arm rotatably connected to the body; and a locking mechanism. The locking mechanism includes: a locking pin at least partially disposed in the first chamber; and a shuttle assembly. The shuttle assembly includes: a shuttle pin at least partially disposed in the locking barrel, engaged with the locking pin, and including a through-bore open to the first chamber; and a check valve. For the pressurized fluid in the locking barrel above a first pressure level, the shuttle pin is displaceable in a first direction to displace the locking pin in the first direction to engage the locking pin with the at least one outer arm. For the pressurized fluid in the locking barrel below the first pressure level: the check valve is displaceable to enable flow of the pressurized fluid from the locking barrel through the through-bore to the first chamber; and the shuttle pin is displaceable in a second direction, opposite the first direction, to displace the locking pin in the second direction to disengage the locking pin from the at least one outer arm.

According to aspects illustrated herein, there is provided a method of operating a switching roller finger follower including a body with a locking barrel, a first chamber partially enclosed by the body, a second chamber partially enclosed by the locking barrel, and a shuttle pin partially disposed in the first and second chambers, the method including: introducing pressurized fluid above a first pressure level into the second chamber; displacing a blocking element for a check valve to block a through-bore in the shuttle pin; displacing, with the pressurized fluid, the shuttle pin in a first direction; and displacing, with the shuttle pin, a locking pin in the first direction to engage at least one outer arm rotatably connected to the body.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
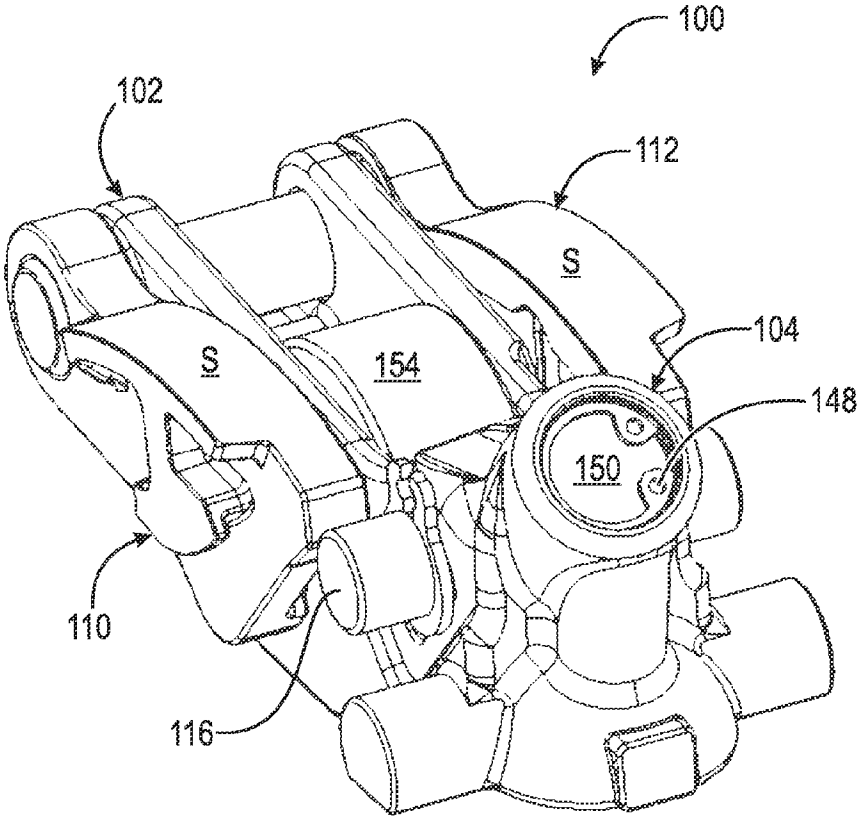
FIG. 1 is a perspective front view of a three-arm switching roller finger follower in an unlocked mode.

FIG. 1 is a perspective front view of three-arm switching roller finger follower 100 in an unlocked mode.

Figure 2:
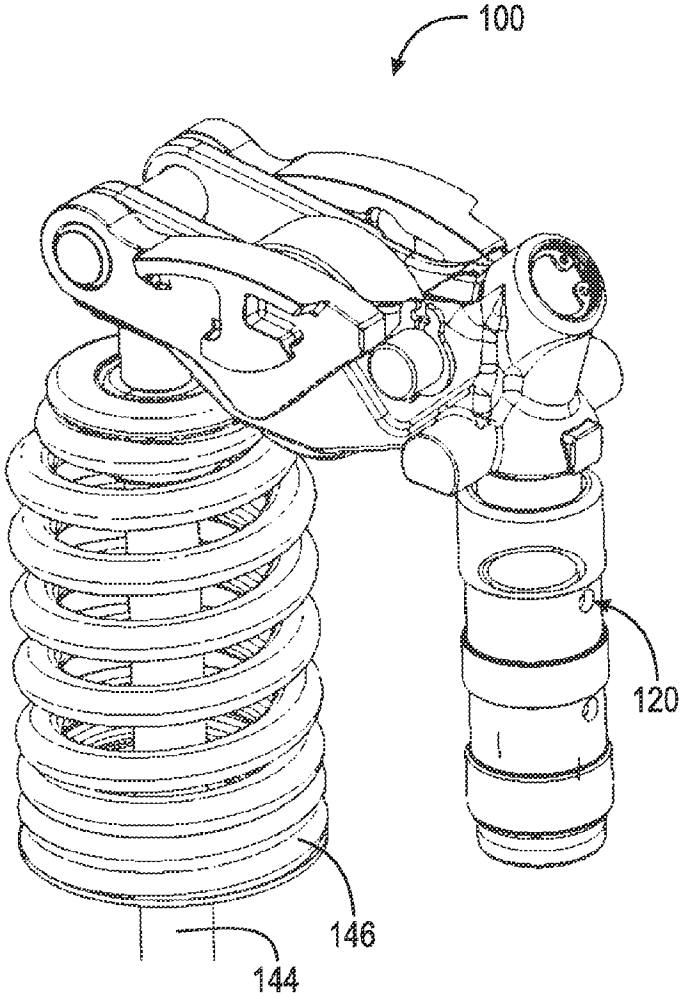
FIG. 2 is a perspective view of the switching roller finger follower in FIG. 1 connected to a lash adjuster and a valve train.

FIG. 2 is a perspective view of switching roller finger follower 100 in FIG. 1 connected to a lash adjuster and a valve train.

Figure 3:
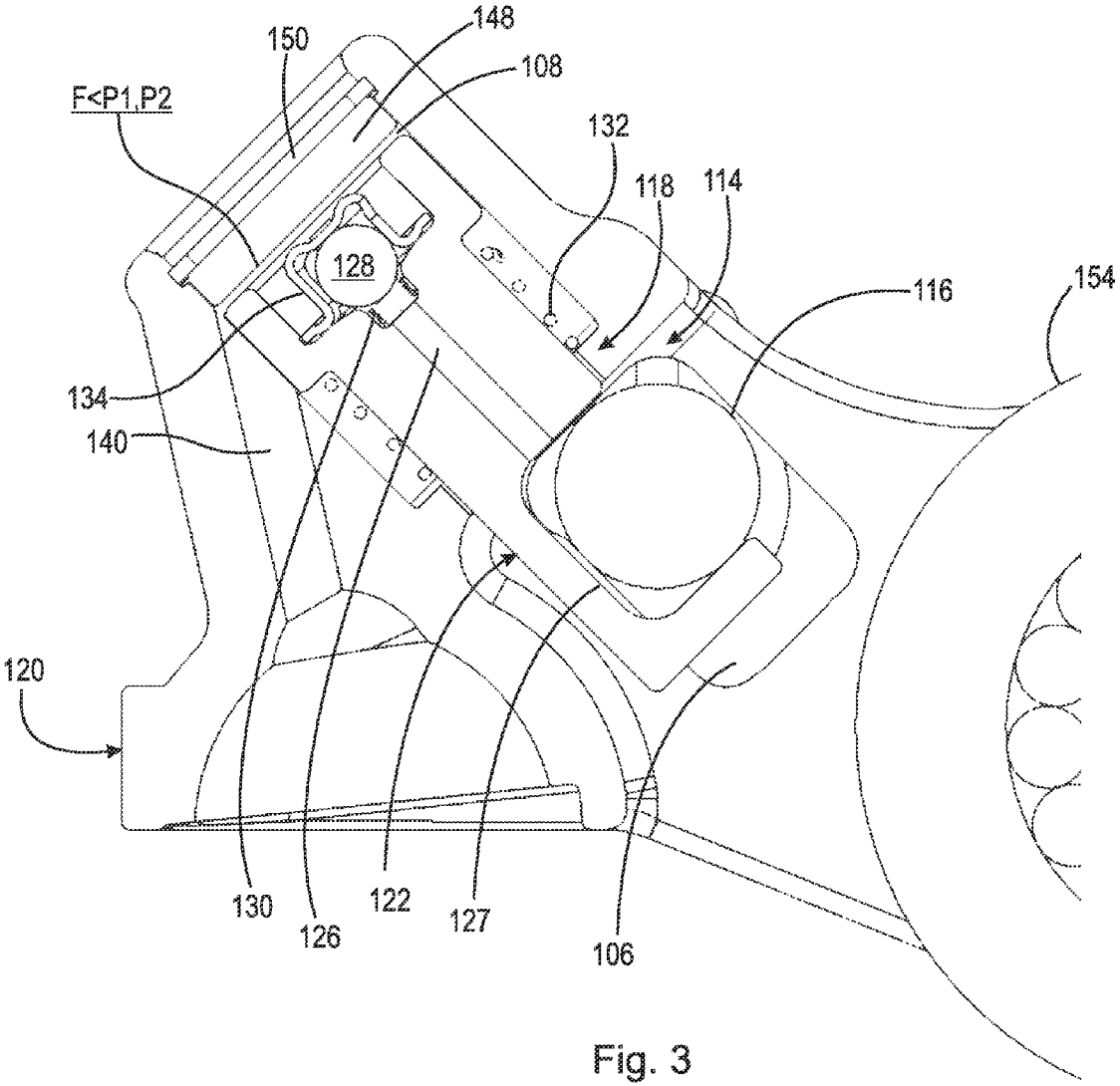
FIG. 3 is a cross-sectional view of the switching roller finger follower in FIG. 1 in the unlocked mode.

FIG. 3 is a cross-sectional view of switching roller finger follower 100 in FIG. 1 in the unlocked mode.

Figure 4:
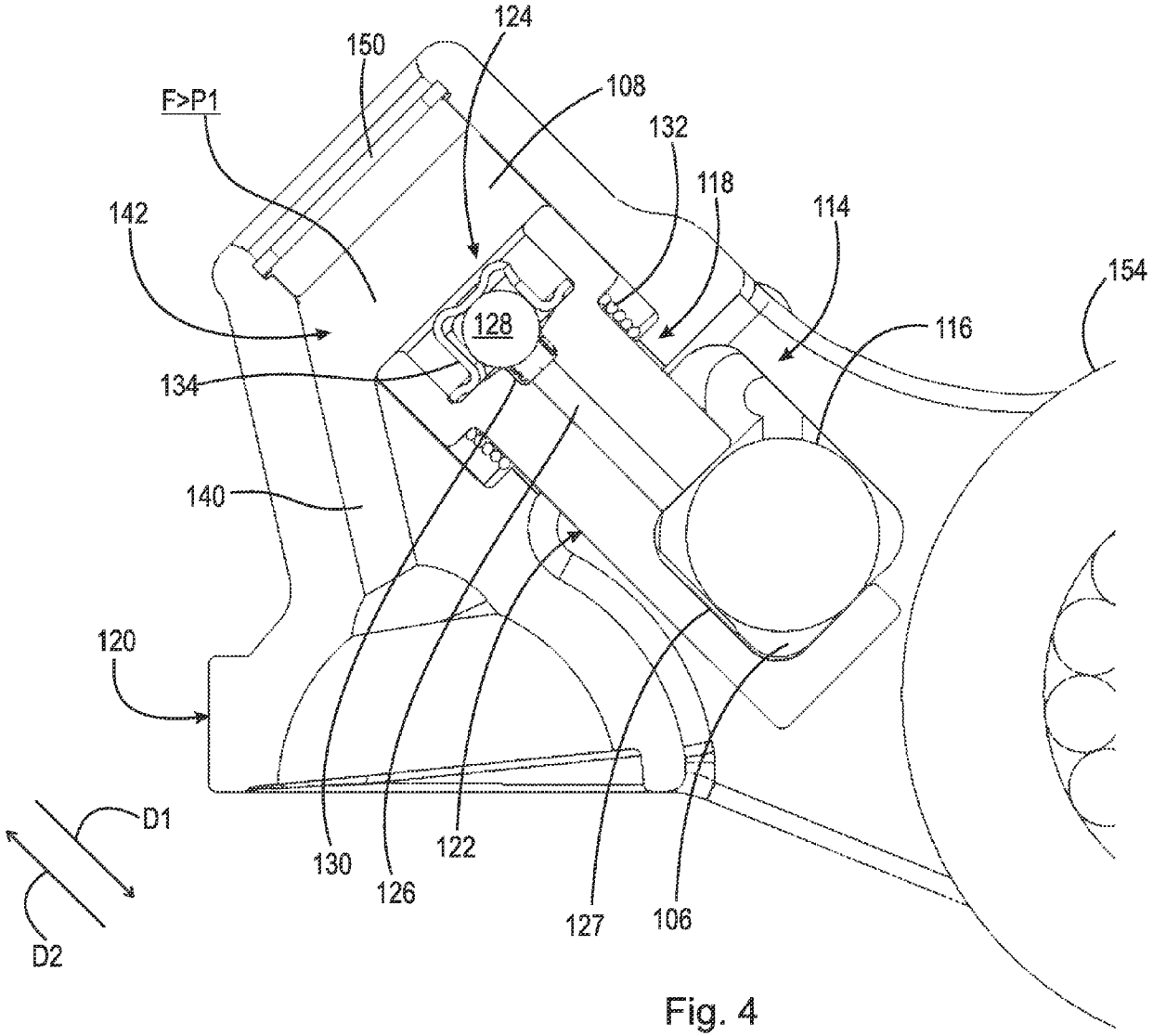
FIG. 4 is a cross-sectional view of the switching roller finger follower in FIG. 1 in a locked mode.

FIG. 4 is a cross-sectional view of switching roller finger follower 100 in FIG. 1 in a locked mode. The following should be viewed in light of FIGS. 1 through 4. Follower 100 includes body 102 with locking barrel 104, chamber 106 partially enclosed by 102, chamber 108 partially enclosed by barrel 104, and at least one outer arm rotatably connected to body 102, and locking mechanism 114 including locking pin 116, at least partially disposed in chamber 106, and shuttle assembly 118. In an example embodiment, follower 100 includes outer arms 110 and 112. Barrel 104, in particular chamber 106, is arranged to receive pressurized fluid F, for example, from lash adjuster 120. The discussion that follows is directed to follower 100 with two outer arms; however, it should understood that the discussion is applicable to follower 100 having other numbers of outer arms.

Assembly 118 includes shuttle pin 122 and check valve 124. Pin 122 is at least partially disposed in chamber 108, includes through-bore 126 in communication with chamber 106, and is engaged with locking pin 116, for example, locking pin 116 is disposed in indent 127 in shuttle pin 122. Pin 122 is displaceable, in response to pressurized fluid F, to engage and disengage locking pin 116 with outer arms 110 and 112. Check valve 124 is arranged to enable flow of pressurized fluid F through through-bore 126 to chamber 106.

As shown in FIG. 4, for pressurized fluid F in chamber 108 above pressure level P1, shuttle pin 122 is displaceable in direction D1 to displace the pin 116 in direction D1 to engage locking pin 116 with outer arms 110 and 112. As shown in FIG. 3, for pressurized fluid F below pressure level P2, less than pressure level P1: check valve 124 is displaceable to enable flow of pressurized fluid F from locking barrel 104, in particular chamber 108, through through-bore 126 to chamber 106; and shuttle pin 122 is displaceable in direction D2, opposite direction D1, to displace locking pin 116 in direction D2 to disengage locking pin 116 from the outer arms 110 and 112.

Figure 5:
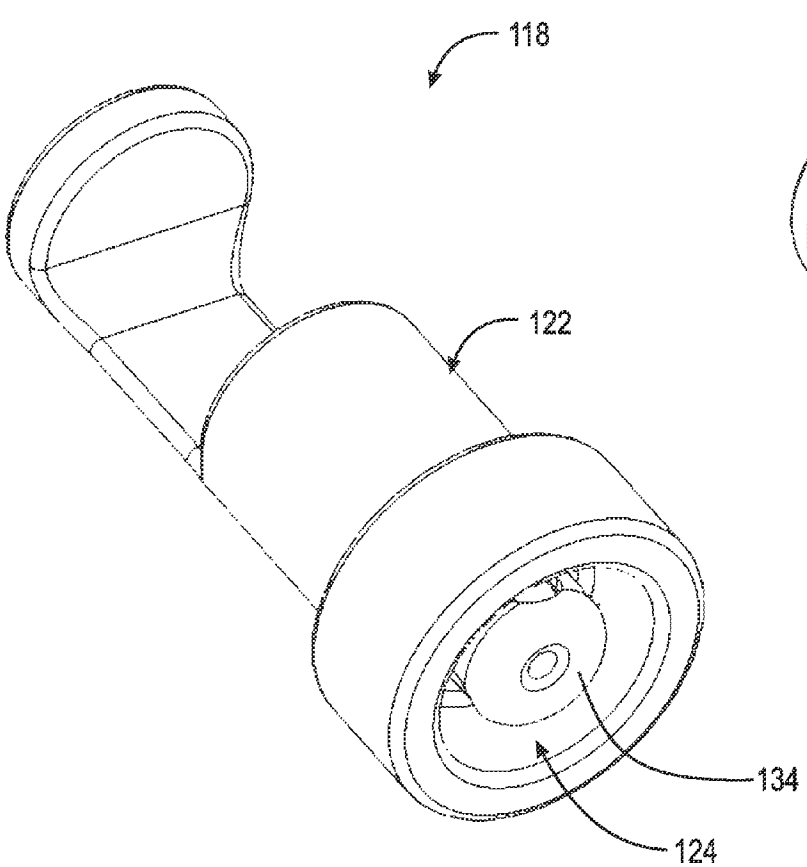
FIG. 5 is a perspective view of a shuttle assembly for the switching roller finger follower in FIG. 1.

FIG. 5 is a perspective view of locking assembly 118 for switching roller finger follower 100 in FIG. 1.

Figure 6:
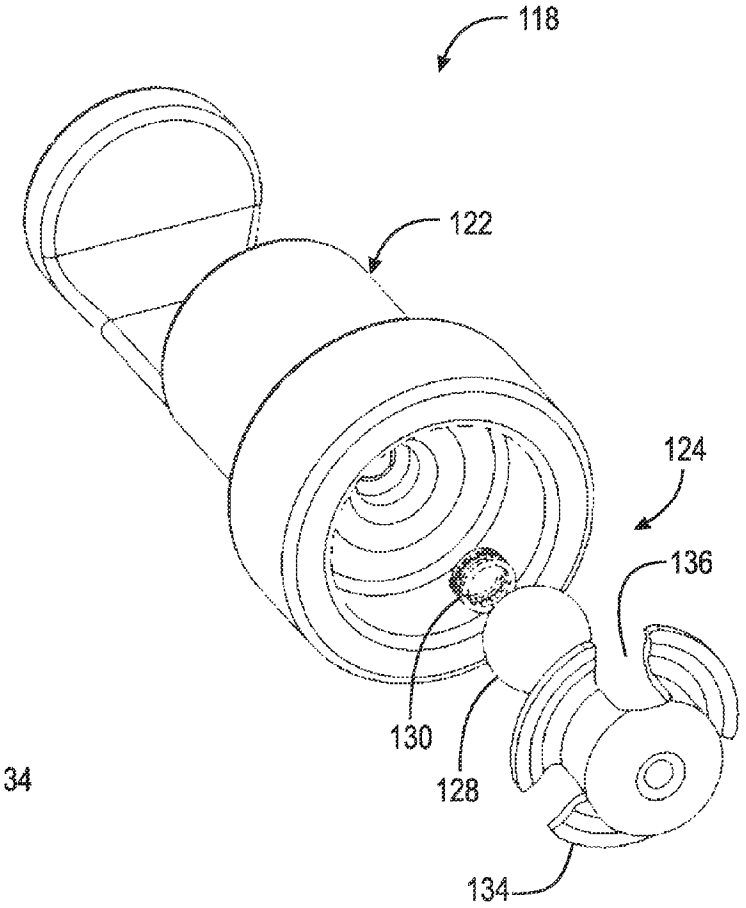
FIG. 6 is an exploded view of the shuttle assembly in FIG. 5.

FIG. 6 is an exploded view of locking assembly 118 in FIG. 5. The following should be viewed in light of FIGS. 1 through 6. In an example embodiment, check valve 124 includes blocking element 128, for example, a check ball, and shuttle assembly 118 includes resilient element 130 engaged with blocking element 128 and blocking element 128 in direction D2. Pressurized fluid F above pressure level P1 is arranged to displace blocking element 128 to block through-bore 126. For pressurized fluid F below pressure level P2, resilient element 130 is arranged to displace blocking element 128 to enable the flow of the pressurized fluid F from locking barrel 104, in particular chamber 108, through through-bore 126 to chamber 106. In an example embodiment, resilient element 130 is at least partially disposed in through-bore 126.

Shuttle assembly 118 includes resilient element 132 engaged with shuttle pin 122 and urging shuttle pin 122 in direction D2. As shown in FIG. 3, for pressurized fluid F less than pressure level P1, resilient element 132 displaces shuttle pin 122 in direction D2 for the unlocked mode.

There are two versions of the unlocked mode for follower 100. In the first version, an engine (not shown) providing energy to pressurize fluid F is not running and there is substantially no fluid pressure in chamber 108. Resilient element 128 pushes blocking element 128 to open through-bore 126 and resilient element 132 displaces shuttle pin 122 to the open position.

In the second version, fluid F is pressurized to below pressure level P1. In an example embodiment, a spring rate for resilient element 132 is greater than a spring rate for resilient element 130. That is, resilient element 132 applies a greater force in direction D2 than resilient element 128. As noted above, resilient element 132 is engaged with shuttle pin 122 and urging shuttle pin 122 in direction D2. In an example embodiment, as the pressure of fluid F is raised, pressure level P2, less than P1, is reached in chamber 108. Pressure level P2 is sufficient to displace blocking element 128 to block through-bore 126; however, due to the difference in spring rates between resilient elements 128 and 132, fluid F at pressure level P2 cannot overcome the force applied by resilient element 130 and resilient element 130 prevents displacement of shuttle pin 122 in the direction D1.

In an example embodiment, check valve 124 includes cap 134 located in chamber 108 and connected to shuttle pin 122. Blocking element 128 is located within cap 134 and cap 134 includes at least one opening 136 to enable fluid flow from chamber 108 to through-bore 126.

Locking barrel 104 includes through-bore 138 open to chamber 108 and arranged to receive pressurized fluid F from lash adjuster 120.

A method of operating switching roller finger follower 100 includes: introducing pressurized fluid F above pressure level P1 into chamber 108; displacing blocking element 128 to block through-bore 126; displacing, with pressurized fluid F, shuttle pin 122 in direction D1; and displacing, with shuttle pin 122, locking pin 116 in direction D1 to engage outer arms 110 and 112.

The method includes: reducing a pressure of the pressurized fluid F in the locking barrel 104 to less than pressure level P1; displacing, with resilient element 128, blocking element 128 in direction D2; flowing pressurized fluid F from locking barrel 104 to chamber 106 through through-bore 126; displacing, with resilient element 132, shuttle pin 122 in the direction D2; and displacing, with shuttle pin 122, locking pin 116 in the direction D2 to disengage from outer arms 110 and 112.

In an example embodiment, the method includes: while blocking through-bore 126 with blocking element 128: urging shuttle pin 122 in direction D2 with resilient element 132; and maintaining a fixed position of shuttle pin 122 with respect to directions D1 and D2. In an example embodiment, the method includes: introducing pressurized fluid F into chamber 108 from lash adjuster 120; and flowing pressurized fluid F through the chamber 106 and out of body 102.

Returning to FIG. 2, follower 100 is shown with lash adjuster 120. Lash adjuster supplies pressurized fluid F to follower 100 as is known in the art, for example, through channel 140 to opening 142 in locking barrel 104. Follower 100 is engaged with valve stem 144 and return spring 146 for a valve train (not further shown) as is known in the art.

In an example embodiment, follower 100 includes seal 148 sealing one end of chamber 108 and held in place by snap ring 150 and bearing 154. Arms 110 and 112 include respective surfaces S arranged to engage with cam lobes (not shown) for a camshaft (not shown).

Advantageously, check valve 124 and through-bore 126 enables faster switching operations for follower 100 while preserving normal operation for follower 100. For example, when blocking element 128 blocks through-bore 126 fluid pressure in chamber 108 operates shuttle pin 122 as normal. However, to speed the transition from locked to unlocked mode, check valve 124 and through-bore 126 eliminate the need to reduce pressure in chamber 108 (to enable resilient element to displace shuttle pin 122 in direction D2) by forcing fluid back through opening 142 and channel 140. Instead, resilient element 128 opens through-bore 126 providing a flow path free of back pressure. Fluid from chamber 108 quickly flows through bore 126 into chamber 106 and out of body 102. Since follower 100 is in an enclosed fluid system, the fluid flowing out of body 102 is recirculated into the fluid pressuring system.

Further, the configuration of resilient element 128 and 132 enable follower 100 to be primed for instant transition from the unlocked to the locked mode. That is, fluid pressure can be built up in chamber 108 up to the threshold of pressure P1. At the threshold, the fluid pressure is enough to close the check valve, but not overcome the force applied by resilient element 132 on shuttle pin 122.

Figure 7:
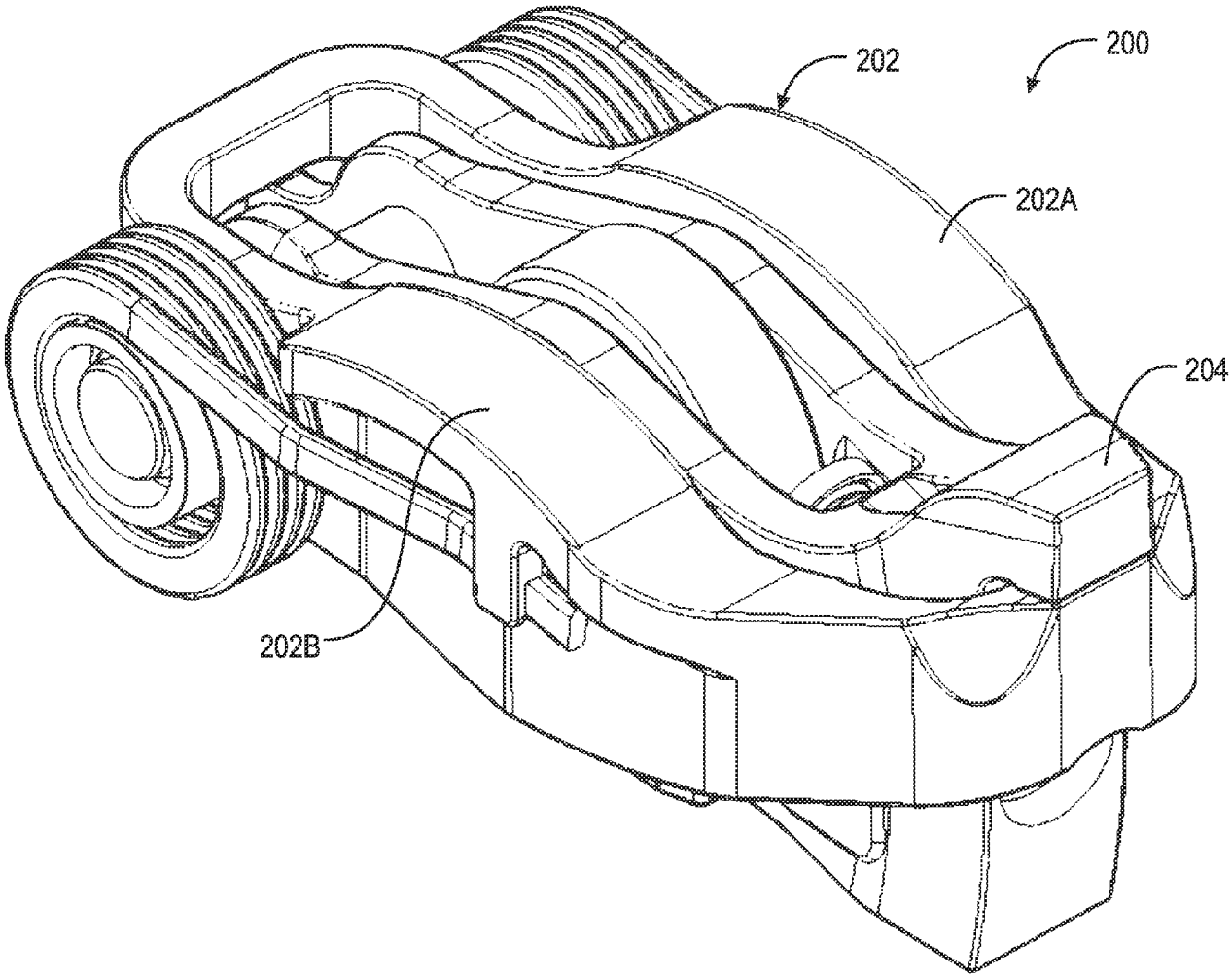
FIG. 7 is a perspective front view of a two-arm switching roller finger follower.

FIG. 7 is a perspective front view of two-arm switching roller finger follower 200. As noted above, the discussion for follower 100 is applicable to roller finger follower 200. Follower 200 includes a single outer arm 202, including portions 202A and 202B, and inner arm 204. Follower 200 includes a single locking pin in a barrel similar to the barrel in follower 100. The single locking pin moves in and out of inner arm 204 to lock or unlock outer arm 202. The same check valve arrangement described above for follower 100 can be used in follower 200 to control operation of the locking pin within the barrel.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A switching roller finger follower, comprising:
- a body including a locking barrel with a first chamber, at least partially enclosed by the locking barrel, the first chamber arranged to receive pressurized fluid;
- a second chamber, separate from the first chamber, partially enclosed by the body;
- at least one outer arm rotatably connected to the body; and,
- a locking mechanism including:
  - a locking pin at least partially disposed in the first chamber; and,
  - a shuttle assembly including:
    - a shuttle pin:
      - at least partially disposed in the locking barrel;
      - including a through-bore in communication with the first and second chambers;
      - including an indent; and,
      - displaceable, in response to the pressurized fluid, to engage and
    - disengage the locking pin with the at least one outer arm; and,
  - a check valve arranged to enable flow of the pressurized fluid from the first chamber through the through-bore to the second chamber, wherein at least a portion of the locking pin is located within the indent for the shuttle pin.

2. The switching roller finger follower of claim 1, wherein:
- the check valve includes a blocking element;
- the shuttle assembly includes a first resilient element engaged with the blocking element and urging the blocking element in a first direction;
- the pressurized fluid above the first pressure level is arranged to displace the blocking element to block the through bore; and,
- for the pressurized fluid below the first pressure level, the first resilient element is arranged to displace the blocking element to enable the flow of the pressurized fluid from the locking barrel through the through-bore to the first chamber.

3. The switching roller finger follower of claim 2, wherein the first resilient element is at least partially disposed in the through-bore.

4. The switching roller finger follower of claim 2, wherein:
- the shuttle assembly includes a second resilient element engaged with the shuttle pin and urging the shuttle pin in the first direction; and,
- a spring rate for the second resilient element is greater than a spring rate for the first resilient element.

5. The switching roller finger follower of claim 2, wherein:
- the shuttle assembly includes a second resilient element engaged with the shuttle pin and urging the shuttle pin in the first direction; and,
- for the pressurized fluid in the locking barrel level less than the first pressure level:
  - the blocking element is displaceable to block the through-bore; and,
  - the second resilient element prevents displacement of the shuttle pin in a second direction, opposite the first direction.

6. The switching roller finger follower of claim 2, wherein:
- the shuttle pin is partially disposed in the second chamber;
- the check valve includes a cap located in the second stage and connected to the shuttle pin;
- the blocking element is located within the cap; and,
- the cap includes at least one opening to enable fluid flow from the second chamber to the through-bore.

7. The switching roller finger follower of claim 6, wherein the locking barrel includes an opening open to the second chamber and arranged to receive the pressurized fluid from a lash adjuster.

8. A switching roller finger follower, comprising:
- a body including a locking barrel arranged to receive pressurized fluid;
- a first chamber partially enclosed by the body;
- at least one arm rotatably connected to the body; and,
- a locking mechanism including:
  - a locking pin at least partially disposed in the first chamber; and,
  - a shuttle assembly including:
    - a shuttle pin:

at least partially disposed in the locking barrel;
engaged with the locking pin; and,
including a through-bore open to the first chamber;
a check valve including a blocking element; and,
a first resilient element:
in contact with the blocking element; and,
urging the blocking element in a first direction to enable flow of the pressurized fluid out of the first chamber through the through-bore.

9. The switching roller finger follower of claim 8, wherein:
pressurized fluid above a first pressure level is arranged to displace the blocking element to block the through bore; and,
for pressurized fluid below the first pressure level, the first resilient element is arranged to displace the blocking element to enable the flow of the pressurized fluid from the locking barrel through the through-bore to the first chamber.

10. The switching roller finger follower of claim 9, wherein the first resilient element is at least partially disposed in the through-bore.

11. The switching roller finger follower of claim 9, wherein:
the shuttle assembly includes a second resilient element engaged with the shuttle pin and urging the shuttle pin in the first direction; and,
a spring rate for the second resilient element is greater than a spring rate for the first resilient element.

12. The switching roller finger follower of claim 9, wherein:
the shuttle assembly includes a second resilient element urging the shuttle pin in the first direction; and,
for pressurized fluid in the locking barrel less than the first pressure level:
the blocking element is displaceable against the urging of the first resilient element to block the through-bore; and,
the second resilient element is arranged to prevent displacement of the shuttle pin in the first direction.

13. The switching roller finger follower of claim 8, further comprising:
a second chamber in the locking barrel, wherein:
the shuttle pin is partially disposed in the second chamber;
the check valve includes a cap located in the second stage and connected to the shuttle pin;
the blocking element is located within the cap; and,
the cap includes at least one opening to enable fluid flow from the second chamber to the through-bore.

14. The switching roller finger follower of claim 13, wherein the locking barrel includes an opening open to the second chamber and arranged to receive the pressurized fluid from a lash adjuster.

15. A method of operating a switching roller finger follower including a body with a locking barrel, a first chamber partially enclosed by the body, a second chamber partially enclosed by the locking barrel, and a shuttle pin partially disposed in the first and second chambers, the method comprising:
introducing pressurized fluid above a first pressure level into the second chamber;
contacting a blocking element for a check valve with a first resilient element;
urging, with the first resilient element, the blocking element in a first direction;
displacing, with the pressurized fluid, the blocking element for the check valve in a second direction, opposite the first direction, to block a through-bore in the shuttle pin;
displacing, with the pressurized fluid, the shuttle pin in the second direction; and,
displacing, with the shuttle pin, a locking pin in the second direction to engage at least one arm rotatably connected to the body.

16. The method of claim 15, further comprising:
reducing a pressure of the pressurized fluid in the locking barrel to less than the first pressure level;
displacing, with the first resilient element and in response to reducing the pressure, the blocking element in the first direction;
flowing the pressurized fluid from the locking barrel to the first chamber through the through-bore;
displacing, with a second resilient element, the shuttle pin in the first direction; and,
displacing, with the shuttle pin, the locking pin in the first direction to disengage from the at least one arm.

17. The method of claim 16, further comprising, while blocking the through-bore with the blocking element:
urging the shuttle pin in the first direction with the second resilient element; and,
maintaining a fixed position of the shuttle pin with respect to the first and second directions.

18. The method of claim 16, wherein the first resilient element is at least partially disposed in the through-bore.

19. The method of claim 15, further comprising:
introducing the pressurized fluid into the second chamber from a lash adjuster; and,
flowing the pressurized fluid through the first chamber and out of the body.

* * * * *